United States Patent [19]

Dunne

[11] Patent Number: 4,728,057

[45] Date of Patent: Mar. 1, 1988

[54] SPIN-STABILIZED PROJECTILE WITH PULSE RECEIVER AND METHOD OF USE

[75] Inventor: Brian B. Dunne, La Jolla, Calif.

[73] Assignee: Ship Systems, Inc., San Diego, Calif.

[21] Appl. No.: 801,171

[22] Filed: Nov. 22, 1985

[51] Int. Cl.[4] ..... F41G 7/26

[52] U.S. Cl. ..... 244/3.16; 244/3.11

[58] Field of Search ..... 244/3.13, 3.16, 3.1, 244/3.11, 3.22; 343/786

[56] References Cited

U.S. PATENT DOCUMENTS

| | | | |
|---|---|---|---|
| 4,097,007 | 6/1978 | Fagan et al. | 244/3.14 |
| 4,210,915 | 7/1980 | Kienberger et al. | 343/786 |
| 4,397,430 | 8/1983 | Heidmann et al. | 244/3.16 |
| 4,500,051 | 2/1985 | Cottle, Jr. et al. | 244/3.16 |

*Primary Examiner*—Stephen C. Bentley
*Assistant Examiner*—Stephen M. Johnson
*Attorney, Agent, or Firm*—Fitch, Even, Tabin & Flannery

[57] ABSTRACT

A spin-stabilized projectile the trajectory of which can be improved to increase accuracy with the projectile being controlled by a source of electromagnetic radiation providing pulses carrying encoded information. The projectile includes a nose end and a midportion having a periphery disposed about which are a plurality of spaced masses with a high explosive charge associated with each mass for high explosive detonation acceleration of its corresponding mass to provide an impulse to the projectile. A projectile has a boatail defining a cavity opened at the rear end of the boatail. Received in the cavity is a pulsed electromagnetic radiation receiver and processor. This radiation receiver and processor has a component for determining the approximate elapsed time from firing of the projectile, a component for determining the direction of the source of electromagnetic radiation with respect to the projectile, a component for determining approximate vertical, a component for determining rotational rate, and a component for counting the times between adjacent electromagnetic pulses in a series of such pulses. The radiation receiver and processor also includes a microprocessor responsive to these components for controlling selective high explosive detonation acceleration of the masses to improve the trajectory of the projectile towards its target. A method of controlling a number of such projectiles is also disclosed.

12 Claims, 14 Drawing Figures

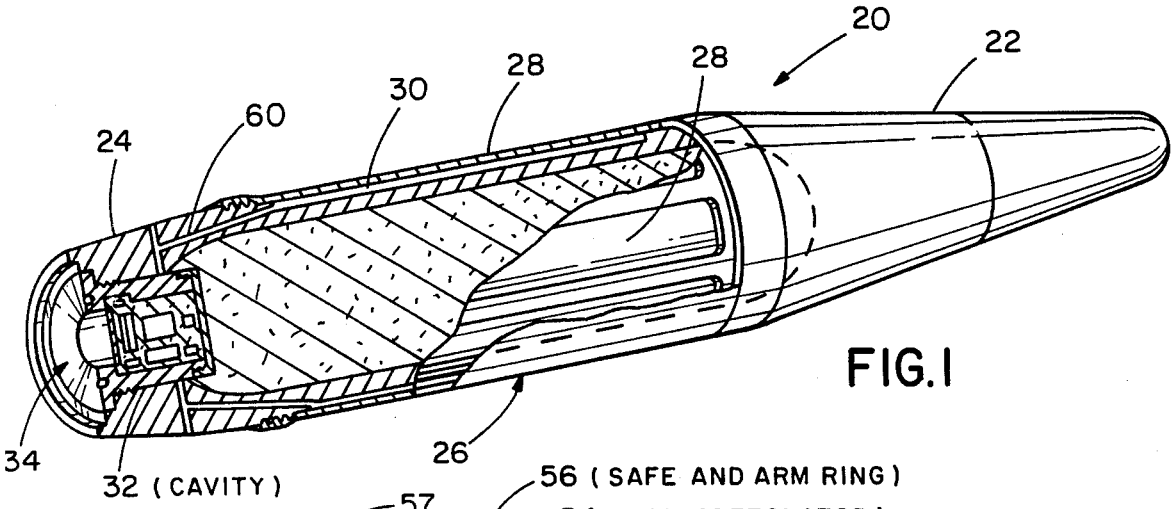
FIG.1
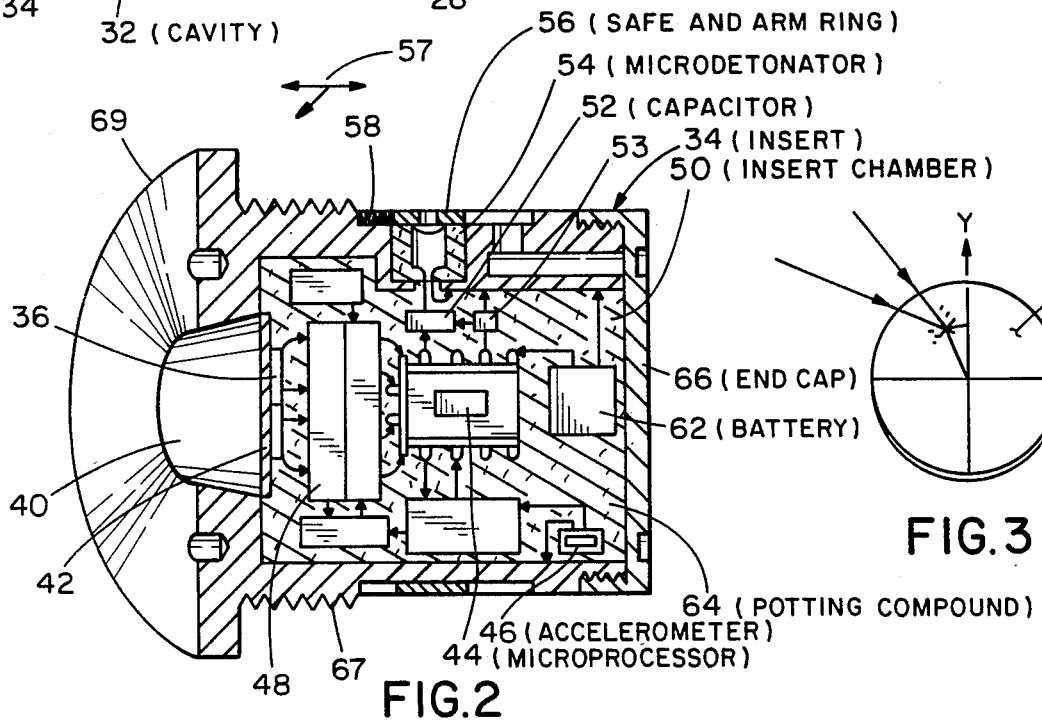
FIG.2
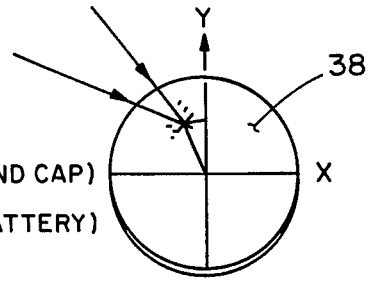
FIG.3
FIG.7
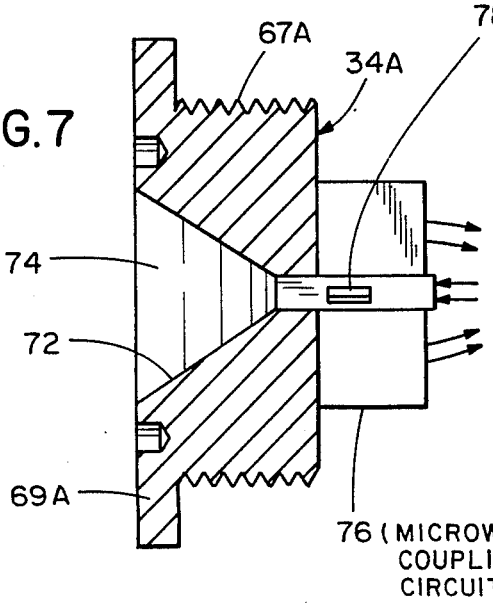
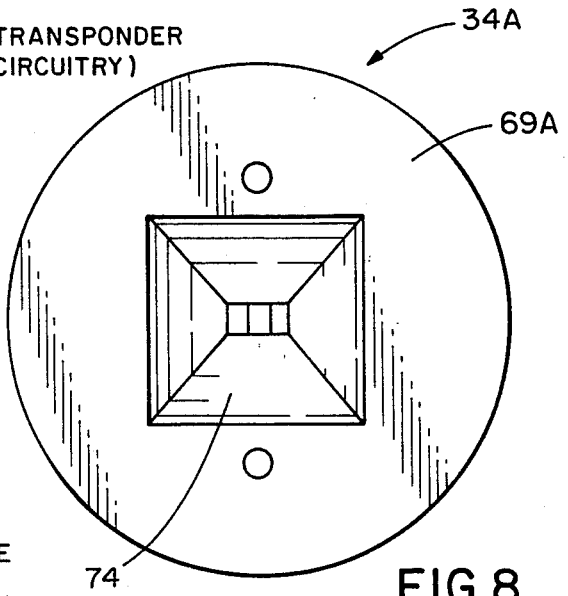
FIG.8

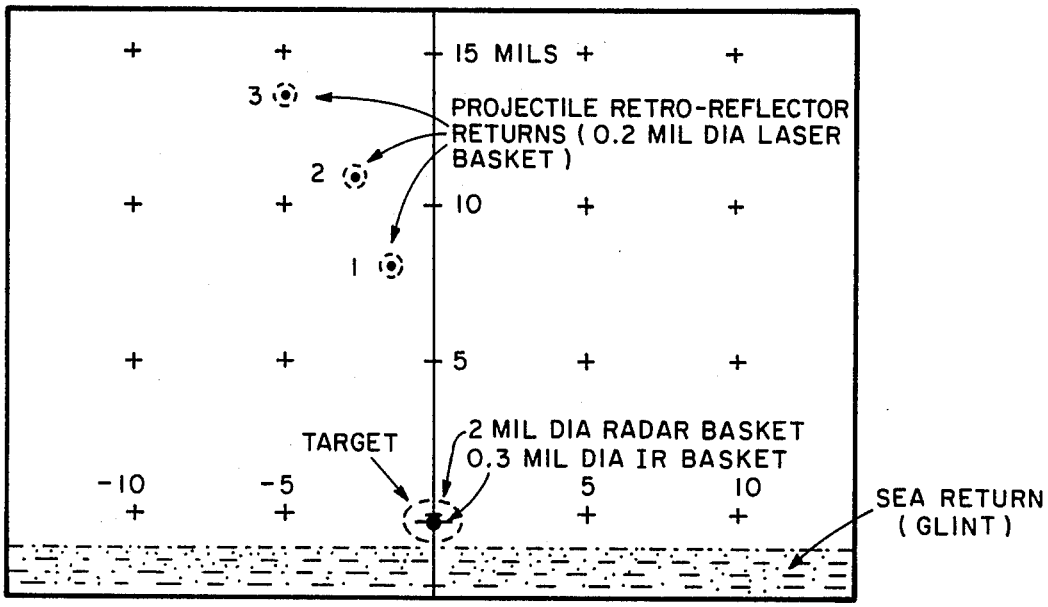

TV DISPLAY OF 1.06μ PULSED LASER RETURN

- AZIMUTH, ELEVATION AND RANGE OF 10 PROJECTILES AND TARGET MEASURED EVERY TENTH SECOND
- AZIMUTH AND ELEVATION MISS DISTANCE PREDICTIONS OF PROJECTILES COMPUTED BY SHIPBOARD BALLISTIC COMPUTER
- COMMAND SIGNALS GENERATED FOR 10 PROJECTILES ARE CONTINUOSLY UPDATED AT 2 HZ RATE
- COMMAND SIGNALS ( WITH RANGE ADDRESS ) ARE TRANSMITTED TO PROJECTILES WITH AMPLITUDE-MODULATED 50 NSEC LASER PULSES
- EACH LGP MAKES OPTIMUM MANEUVER USING EXPLOSIVE SIDE THRUSTERS
- WHEN PROJECTILES PASS TARGET THEY ARE LASER COMMAND AND/OR PROXIMITY FUZED

FIG. 9

VERTICAL REFERENCE FLOW DIAGRAM
( QUAD CELL INPUT )

REVOLUTION COUNTER FLOW DIAGRAM

SPIN-STABILIZED PROJECTILE WITH PULSE RECEIVER AND METHOD OF USE

The present invention relates generally to guided projectiles and, more specifically, to projectiles controlled by pulses of electromagnetic radiation.

BACKGROUND OF THE INVENTION

One of the major threats to surface ships is the surface-skimming type of missile. Currently-employed defense of ships against surface-skimming and other types of anti-ship missiles calls for the complementary employment of both guns and anti-missile missiles. More specifically, the relatively expensive anti-missile missiles are effective at longer ranges. However, for shorter ranges, with their attendant short response time, rapid-fire medium-caliber gun-fired projectiles are preferred. While these projectiles, which may employ proximity sensors to initiate fragmentation, are very inexpensive, they are not guidable after firing and a great number must be used to achieve a probability of target destruction.

A system of using a continuous wave laser beam to control the high explosive detonation acceleration of masses carried by low-cost spin-stabilized projectiles, thereby improving the trajectory of the projectiles, has been developed. A salient advantage of this system is that the receiver is mounted in a shrouded portion of the boatail to prevent radiation other than that from a source behind the projectile from being received. Thus, the system is effectively countermeasure-proof. The structure and operation of this system are described in commonly-assigned U.S. Pat. No. 3,860,199, the teachings of which are hereby incorporated by reference. Foreign patents based on this patent are as follows: Canada: No. 1,009,370; No. 1,014,269—Switzerland: No. 561,893; No. 574,094—Italy: No. 976,742—Israel: No. 41,097;—Great Britain: No. 1,429,941—France: No. 7300093—Germany: Nos. 2264243, 2500232. While the operation of this system is satisfactory, improvements in operating range and accuracy are always desired.

It has also been proposed to lay explosives in helical grooves in the body of a projectile to provide thrust and also a torque thereby reducing low frequency precession and higher frequency nututional motion, so that a body-fixed nose-seeker might be feasible. Nose seekers rely on radiated energy produced or reflected by the target while beam riders are controlled by emitted radiation at or near the gun system. Unfortunately, such helical grooves are expensive and difficult to fabricate. For further information regarding this projectile and its operating system, reference may be made to U.S. Pat. No. 4,347,996. Helical grooves are unnecessary in a beam-riding projectile because the gyroscopic motions due to a small transient yaw produced by the thruster action diminish with an exponential time constant on the order of several tenths of a second, and hence, by proper sequencing of the explosive thrusters, can easily be tolerated.

With the present state of art, a 1.06 micron wavelength Neodymium YAG laser for shipboard use can transmit 200 millijoule pulses of 50 nanoseconds duration at pulse repetition frequencies of about 100 Hertz. Laser rangefinders using such parameters are regularly mounted on, and boresighted with, anti-ship-missile system millimeter radar tracking units to provide more accurate target positions. They are generally used at ranges, varying with visibility, of 3–12 kilometers. These desired trajectories of projectiles to be fired at the target are calculated by fire control computers, employing the most updated information about target position. Nevertheless, after the projectile leaves the gun, trajectory errors accrue due to unpredictable target motion, wind, and the usual projectile dispersion relating to a large number of uncontrolled variables.

SUMMARY OF THE INVENTION

Among the several aspects and features of the present invention may be noted the provision of an improved guidable projectile and a system for use therewith. The system preferably employs a pulsed laser providing encoded information for contolling the guidance of the projectile. As pulsed lasers are of much greater power than continuous wave lasers the guided projectiles can be controlled at greater distances and under more severe weather conditions than heretofore possible employing continuous wave lasers. In the system of the present invention, a series of projectiles, e.g., 10, can be individually controlled to increase accuracy. The system used in the present invention employs many currently available components. The projectiles and the receivers incorporated therein are of small size and radiation weight, are reliable in use and have long storage life, and are relatively easy and inexpensive to manufacture. Other aspects and features of the present invention will be in part apparent and in part pointed out hereinafter in the following specification and in the accompanying claims and drawings.

Briefly, the projectile of the present invention includes a nose having the option of addition of a proximity fuse, a midportion central region largely filled with high explosive with a plurality of explosive thrusters disposed about the periphery thereof, a boatail and a pulsed electromagnetic radiation receiver and processor mounted within the boatail. The radiation receiver and processor includes a component for determining the elapsed time from firing the projectile, a component for determining the direction of the source of electromagnetic radiation with respect to the projectile, a component for determining approximate vertical, and a component for counting the times between adjacent electromagnetic pulses in a series of such pulses. Furthermore, a microprocessor is included which is responsive to the output of these various components to accurately control the various thrusters to improve the trajectory of the projectile.

BRIEF DESCRIPTION OF THE DRAWINGS

FIG. 1 is a perspective view of a spin-stabilized projectile incorporating various features of the present invention with part of the midportion and boatail broken away to expose other components of the projectile including a receiver apparatus for reception of pulses of electromagnetic radiation from a laser;

FIG. 2 is a longitudinal cross-sectional view of a boatail insert holding the receiver apparatus and a lens for receiving the pulses of radiation;

FIG. 3 shows a pulse of radiation, focused by the lens of FIG. 2, impinging on the upper left quadrant of the detection surface of a quad cell x-y position indicator;

FIG. 7, similar to FIG. 2, is a longitudinal cross-sectional view of an alternative embodiment of the boatail insert which defines a waveguide horn for use when the source of pulses of electromagnetic radiation is a radar transmitter;

FIG. 8 is a fragmentary end view of the boatail insert of FIG. 7;

FIG. 9 is a representation of a television display of a pulsed laser return;

Corresponding reference numbers indicate corresponding components throughout the several views of the drawings.

DESCRIPTION OF THE PREFERRED EMBODIMENTS

Figure 4:
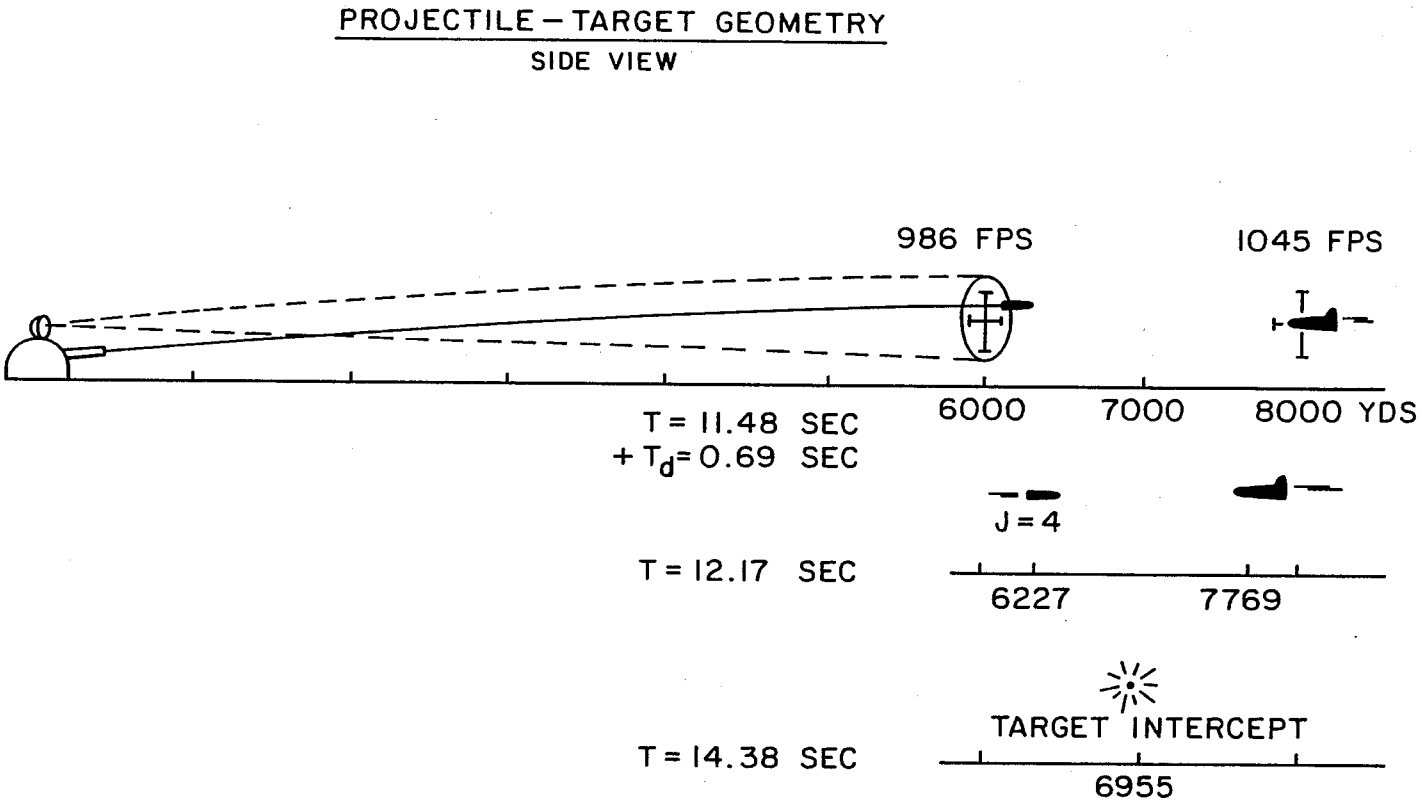
FIG. 4 is a side elevational view illustrating the projectile and target geometry as well as the gun and pulsed laser tracking system.

Referring now to the drawings, a spin-stabilized, gun fired projectile embodying various features of the present invention is generally indicated by reference numeral 20. The projectile 20 includes a nose 22 which is able to house a proximity fuse for detecting that the projectile is sufficiently close to fire the central explosive base fill charge causing resulting fragments of the projectile body to strike and render ineffective the target. The projectile 20 also includes a boatail 24 and a midportion 26 about the periphery of which are disposed a number, e.g., 8, of elongate masses 28 with a high explosive charge 30 underlying each mass. As is more fully described in U.S. Pat. No. 3,860,199, the teachings of which have been incorporated herein by reference, high explosive detonation acceleration of a mass 30 (thruster) functions to apply an impulse normal to the longitudinal axis of the projectile. This results in a change in the trajectory of the projectile to improve its accuracy.

Figure 6:
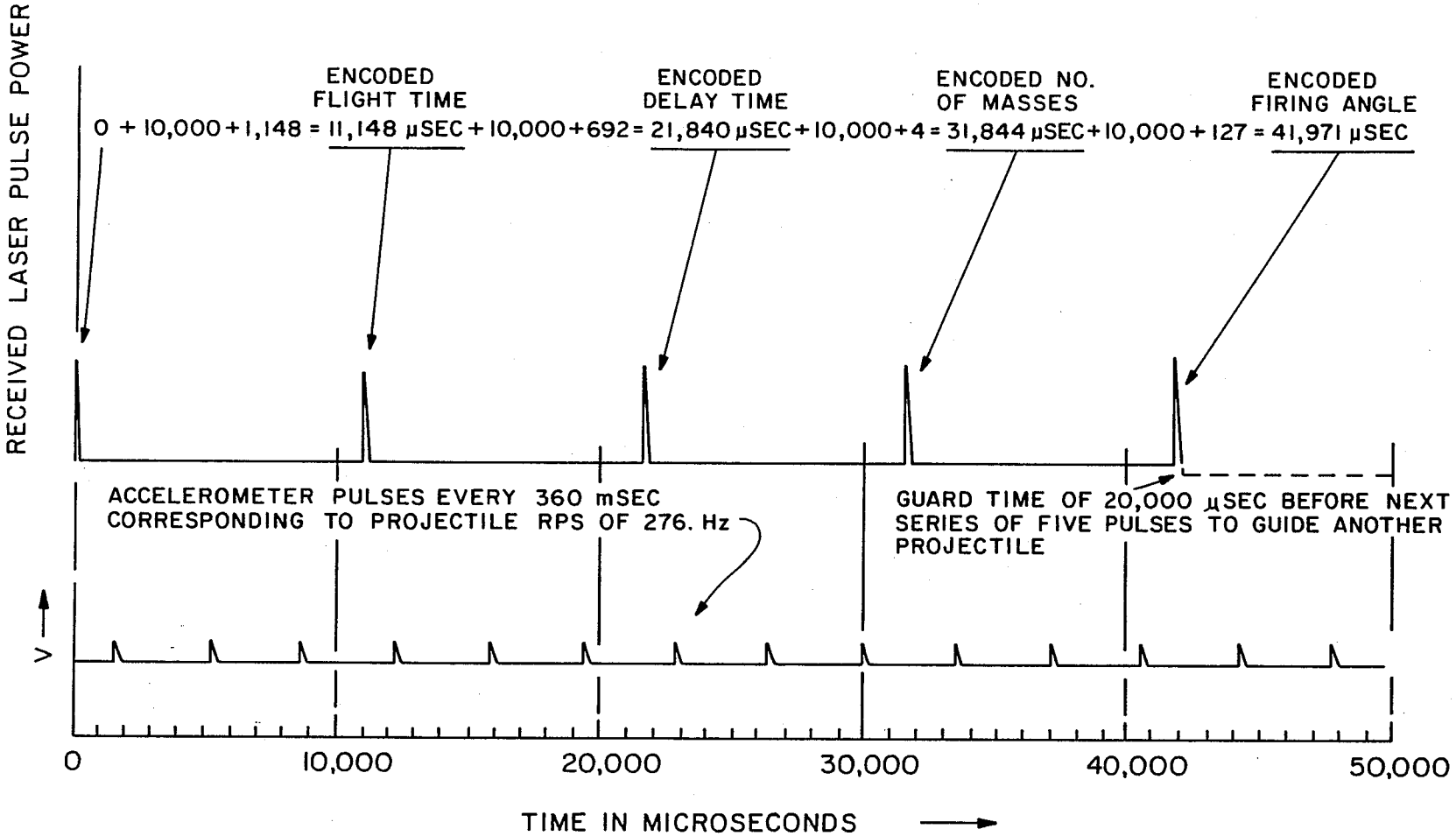
FIG. 6 is a graph plotting the occurrence of a series of pulses against time indicating encoded information and instructions carried by the pulse train, as well as voltage pulses from an accelerometer in the projectile.

The boatail 24 defines a cavity 32 extending to the rear of the boatail for threadably receiving an insert 34 housing apparatus for receiving and processing a series of electromagnetic radiation pulses such as depicted in FIG. 6. The receiver apparatus includes a quadrature cell 36 having a radiation impingement surface 38, see FIG. 3. A focusing lens 40 and a filter 42 overlay the surface 38. As will be set forth more fully hereinafter, the location at which the focused radiation strikes the surface 38 is used by a microprocessor 44 to establish vertical. An accelerometer 46 provides a pulse signal with each rotation of the projectile to provide constantly updated information as to the approximate vertical, and very accurate projectile angular rotational rates.

The encoded pulses shown in FIG. 6 may provide the following information: The time interval between pulses A and B serves to identify which of a plurality of sequentially fired projectiles 20 is currently being addressed. The time interval between pulses B and C indicates the delay time before a number (which may be 1) of masses 28 are to be blasted off. The time between pulses C and D indicates the number of masses to be used. Finally, the time between pulses D and E provides the angle with respect to vertical at which the masses are to be blasted off.

One other factor to be considered relative to an algorithm reflected by the program of the microprocessor is the yaw angle of the projectile which is caused by gyroscopic and aerodynamic forces. Fortunately, the yaw angle can be easily determined by a simple formula as will be discussed hereinafter.

This present invention represents an improvement on the prior art in that it substantially increases the projectile accuracy. It also extends the useful range, provides a considerable degree of all-weather capability against antiship missiles, and simplifies the processing microcircuitry. This is accomplished primarily be the use of a pulsed laser beam with a sufficiently large conical beam angle (about 50 milliradians), which can illuminate a number of projectiles in a series so that tracking of each projectile may be accomplished by recording its x,y position and range by means of a TV vidicon or Charged Coupled Device (CCD) at the focal plane of a telescope located at the source of the laser beam. The present invention fills the need to maneuver each projectile separately out to ranges of about 8–10 kilometers. Since the projectile must pass the target within about two meters to be effective, this requires tracking errors not exceeding $\pm 0.1$ milliradian and ranging errors of less than $\pm 5$ m. and high precision in the firing of the explosive thrusters.

More specifically and referring to FIG. 2, the electromagnetic radiation receiving apparatus includes a quadrant detector in the form of the laser quad cell 36, made of a doped silicon wafer, and having a noise equivalent power of about $10^{-13}$ watts, a sensitivity of 0.15 amps/watt and a time constant of about 15 nanoseconds. It responds with an easily detectable voltage signal across a 50 ohm resistor, when used with a 2 cm diameter IRTRAN (infrared transmitting) lens 40 and the filter 42 with transmittance of 90%, over a range of 6 kilometers and reasonable visibility. An example of such a cell is part No. SPOT/9D for use with an analog to digital converter 48, e.g., part No. Model 431 X-Y Optical Position Indicator, both the cell and the position indicator being manufactured by United Detector Technology of Hawthorne, Calif.

The use of a quadrant detector, such as cell 36, to determine the direction from which either radar or laser wavelength radiation is produced is a well-known technology to those skilled in the art. In the case of radar wavelengths, clusters of four waveguide horns gather the electromagnetic energy and by summing, differencing, and normalizing the signals from detectors at the waveguide terminations, the direction of motion of the entering radiation may be determined.

With laser wavelengths, lenses or mirrors focus radiation on the quad cell detector, and similar summing, differencing and normalizing procedures are used. This invention uses such detectors to provide accurate input data to microprocessors which in turn actuate the highly precise explosive thrusters for maneuvering spin-stabilized projectiles 20.

It is assumed that the projectiles are tracked by the usual systems, either with a laser or a radar, or both. These tracking pulses can also serve to provide accurate uplink data, which used together with the vertical reference data obtained with the quadrant detector steer the projectile with previously unattainable accuracy.

While the system description primarily describes the pulsed laser receiver version, since this is most applicable to the three-inch caliber, it should be emphasized that both laser and radar quadrant detectors (discussed hereinafter in relation to FIGS. 7 and 8) can be easily mounted on boatail receivers of larger caliber projectiles—the computational processing technique from the quadrant detector, be it either a radar waveguide cluster or a laser quad-cell is identical.

In the case of a 95 gHz M-Band radar with wavelength 3.1 mm, the waveguides are sufficiently small to be included in a medium caliber projectile. More usual frequencies of trackers ar KA Band at about 35 gHz, and 8.6 mm wavelengths, suitable for 5". calibers and above. Since the pulse repetition rate for radars is much higher, 6–10 KHz being typical, the tracking rates and pulse encoding is much more rapid than with the laser. However, the tracking accuracy is better at the laser wavelengths.

As shown in FIG. 2, the cone-shaped planar-convex focusing lens 40 (made of an infrared transmitting material such as IRTRAN) is cemented to the daylight filter 42 which is in turn cemented to the cell 36. The lens is wedge-fit into the constricted open end at the rear of the insert 34. This arrangement, along with cementing and potting of various electronic components in the insert chamber 50, allows the various components of the receiving and processing apparatus to withstand the high (50,000 g) setback forces occasioned by firing of the projectile, as well as the shock waves generated by detonating the explosive thrusters.

Signals of x and y positions of the spot as a function of time from the cell 36 and converted from analog to digital by converter 48 are used as one input to the microprocessor 44. The receiver apparatus also includes an accelerometer 46 sensitive to the aerodynamic body forces on the projectile, such as is known from the German Auglegeschrift DE No. 28 53 779 B2. An alternative is an existing solid state integrated accelerometer consisting of a silicon dioxide cantilever beam sensor, loaded with a gold mass for increased sensitivity and coupled with an MOS detection circuit followed by a differentiator and rectifying diode, all on one substrate. This accelerometer can be easily packaged with associated circuitry and output leads in a unit no more than 0.025 $cm^3$ in volume. In either embodiment, the accelerometer (and associated circuitry) supplies a sharp pulse (of perhaps 5 V) to the microprocessor 44 each time the accelerometer is a particular roll position thus establishing a fiducial vertical with each revolution of the projectile. Not only does this supply approximate information regarding vertical to the microprocessor between radiation pulses, but also is used as an input to an accurate counter to keep an accurate count of total rotations of the projectile.

Upon determination that a particular mass 28 is to be blasted off, the microprocessor 44 triggers a solid state 53 switch which discharges a capacitor 52 into a preselected microdetonator 54. As shown in FIG. 2, microdetonators 54 are positioned behind in cavities filled with shock absorbent material in the wall of the insert 34, with one microdetonator for each mass 28. The microdetonator assembly also includes a metal S/A (safe-and-arm) ring 56. The ring 56 is moved rearwardly (setback) upon firing of the projectile which also causes its rotation. A spring 58 (which is overcome by the firing forces) biases the ring 56 forward after firing into a pneumatic reservoir exhausted through a bleed hole. Only after the ring undergoes this combination of translational and rotational movement (as indicated by the 3 arrows 57 joined together) is the ring aperture properly aligned with a channel 60 communicating with the charge 30 for the preselected means 28 so that small metal fragments fired by the microdetonator go through the ring opening and detonate an explosive train laid in the channel 60. These fragments initiate a high order (7 mm/MSEC velocity) detonation in the explosive thruster explosive train, which has a diameter of about 1.2 mm, sufficiently larger than the explosive failure diameter so as to reliably transmit this detonation wave to the corresponding high explosive thruster charge 30.

All the above mentioned microcircuitry is powered by a setback battery 62 potted in the insert chamber. The battery switches on to provide electrical energy upon being acted upon by the high force caused by firing of the projectile. All the microprocessor and associated electrical components are held in the chamber of the insert 34 by the potting compound 64 with the forward end of the insert chamber being closed by a threaded end cap 66. So that the insert does not unscrew upon projectile rotational acceleration in the gun barrel, the insert periphery has reverse threads (as in the practice with projectile screw-in base fuses) for cooperation with mating threads on the surface defining the boatail cavity 32. The metal insert 34 serves as an electrical ground for the various electrical components of the receiving and processing apparatus. The insert 34 has a protective shroud 69 which serves as a stop to limit insertion and also limits the angle at which radiation can enter the lens 40.

Figure 5:
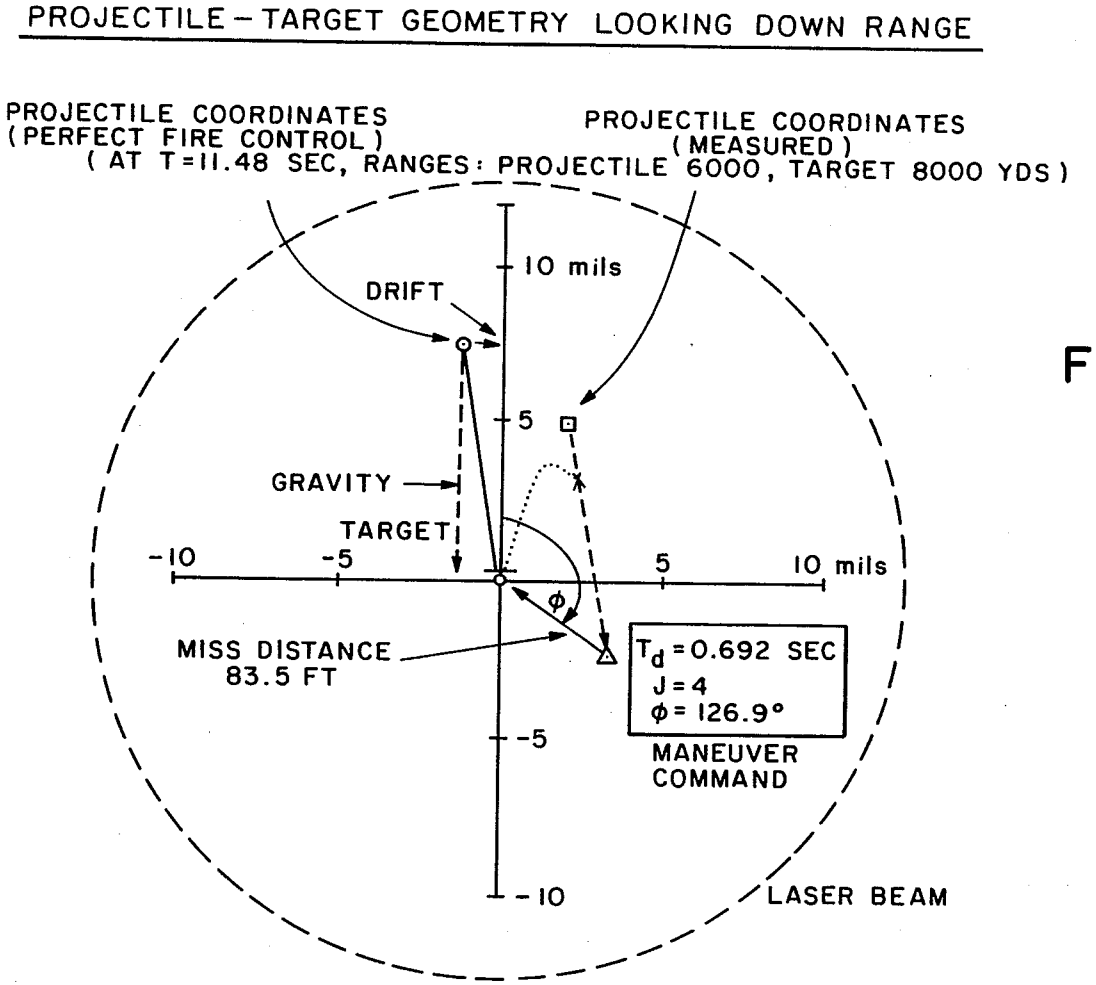
FIG. 5 is a graphical representation of the projectile and target geometry looking down range as from a ship.

The method of using pulses from the source of electromagnetic radiation, a laser range finder 68, to both track the projectile 20 and transmit a maneuver signal can best be examined by referring to the maneuver example in the intercept diagrams of FIGS. 4 and 5. FIG. 4 is the side view of a particular projectile-target geometry using data from the range tables of a 3"/50 projectile. At a time after firing of 11.48 seconds and range 6,000 yards the laser rangefinder 68 finds the projectile 20 in the upper righthand quadrant (viewed from the ship, the center of this quadrant being boresighted with the incoming missile (the target 70) (closing at 1,045 feet per second and at 8,000 yards).

Referring to FIG. 5, relative to the ship, the target 70 as before is at the center of the laser boresight. However, if the fire control were perfect the projectile 20 should be found in the upper left quadrant in the position, as shown, so that in closing to the target it would both (1) fall under gravity and (2) drift to the right (because of the combination of gyroscopic and aerodynamic forces). The projectile, in the observed position, however, without a trajectory correction, would fall along the dashed line from its measured position (from the square to the triangle) and pass the target with a miss distance of 83.5 feet. The vector correction to close toward the target would require, with a usual thruster momentum, that four thrusters (masses 28) be fired (J=4) at a delay time ($T_d$) of 0.692 seconds and at an angle from vertical (0) of 126.9°. The trajectory after this correction is shown by the dotted line. These three commands are sent to this particular projectile (addressed by its time after firing, 11.48 seconds), as is shown in the pulse sequence illustrated in FIG. 6.

The internal clock of the receiver and processor apparatus, provided by the functioning of a crystal oscillator and the accelerometer 44, will, of course, not be in exact synchronism with the address given by the delay time between pulses A and B. Ordinarily, the projectiles in an anti-ship missile encounter will be fired at rates of about sixty per minute, and thus spaced in flight times by about one second intervals. Thus for decoding purposes, the projectile microprocessor will accept a time-of-flight address if it falls within, for example, plus or minus a quarter second of the internally measured time of flight. The receiver and processor apparatus uses the A to B pulse interval to decode the particular projectile being addressed, the time between pulses B and C to obtain the thruster firing delay time, the time between pulses C and D for the number of thrusters to fire, and the time between pulses D and E for a command of the firing angle from vertical. After the fifth (E) pulse of the shipboard computer controlled laser pulser pauses for a quiescent or guard time of, for example, 20,000 microseconds before proceeding with the next series of five command pulses to another of the series of projectiles 20 which were fired at the target 70.

In this particular example, the projectile spin rate, calculated from the initial rate, and the spin rate decay with time, is 276.32 Hz. From the calculated delay time of 0.692 seconds, the number of spin revolutions from receipt of the command signal fifth pulse can be calculated to be 191.21 revolutions.

Short duration revolution count pulses are continually being produced by the accelerometer module at the position of the fiducial vertical. Because the true vertical has been updated by the quad cell signal upon receipt of the laser pulses received, (but not necessarily otherwise processed) about every 20,000 microseconds, the projectile circuitry can program the thruster firing times, spacing them appropriately around 0.692 seconds, but choosing the nearest integral revolution to generate the firing angle for a particular thruster. Thus, for firing four thrusters, the appropriate revolutions may be programmed to be 188, 190, 192 and 194. This thruster detonating technique, together with choice of a suitable potting compound around the microprocessor would diminish the strength of the shock waves due to the firing of the thrusters, and also damp out the yaw oscillations.

The direction of true vertical can be obtained by correction for small horizontal yaw vector component. For the 3"/50 projectile the instantaneous yaw angle is accurately given by the equation $Y=0.0748T^{1.807}$ where Y is the yaw angle in milliradians, and T is the flight time of the projectile in seconds. With the above example, at T=11.38 seconds, the yaw angle is 6.155 mils, and the pitchdown angle is 167.2 mils. The clockwise angular correction to obtain true vertical is thus very nearly 2.11°. This is a fairly small correction but for ranges of 12,000 yards it becomes about 4.7°. Thus the information regarding yaw can be supplied in a look up table in the microprocessor.

By this method about 10 projectiles can have their trajectories accurately updated about every 0.6 seconds, a very reasonable rate. However, by encoding the pulses, using more complex techniques, this update rate can be increased, if desired. FIG. 9 is a representation of a television display of the pulsed laser return.

Vertical is not exactly at the peak of the sinusoidal signal from the accelerator 46—it shifts slightly due to the slightly changing radial component of the resultant of the aerodynamic forces on the projectile, and will also shift during and immediately after explosive thruster action. These errors can be compensated and corrected by use of the accurate laser reference vertical from the quad cell signal. However, this vertical will shift only very slightly during the delay time from the receipt of the pulses coded instructions until the time of thruster firing.

FIG. 3 is a greatly enlarged view looking down the projectile axis (from the boatail end of the projectile) at the surface 38 of the quad cell 36. Because of the pitchdown angle and righthand yaw of the projectile 20, (when viewed from the ship) the focused spot appears above and to the left of the quad cell axis. (True vertical would be in the y direction in this diagram).

It is entirely feasible to extend the application of this receiver processing technique by the addition of a simple radar wave receiver, which is a quadrant horn, the four wave guides transmitting the electromagnetic radiation to thermistor detectors located at the correct nodal points in the wave guides and the A.C. signals are then rectified by diodes, and subsequently amplified. The analog to digital converter would receive this output and provide a digitized version, indicating true vertical, to the microprocessor. The pulse coding of this radar transmitter system can be identical to the laser pulse coding, thus supplying two channels of information. Additionally, by use of a very low power transmitting circuit also controlled by the microprocessor, an electromagnetic pulse may be caused to emit from the quadrant transponder. This transponding function would allow the projectile to be tracked with greater accuracy. The millimeter wave channel has the disadvantage that it is less accurate than the laser channel, but it has the advantage that it will operate at extended ranges and is generally more useful in low visibilities.

Referring now to FIGS. 7 and 8, a portion of an alternative embodiment of the insert is generally indicated at 34A. Components of insert 34A corresponding to components of insert 34 are indicated by the reference numeral assigned to the component of insert 34 with the addition of the suffix "A". The insert 34A is a microwave alternative and defines a single waveguide horn 72. The technique uses higher-order waveguide modes, e.g., $TE_{20}$, in addition to the usual $TE_{10}$ mode. The feed throat 74 is large enough to allow higher order modes to propagate to microwave coupling circuitry 76 to extract the desired modes. The system is compact, simple, has low loss, radiation weight, and low aperture blockage, with a short, symmetrical structure. It provides sum and difference signals without complex capacitor circuitry. Such a feed can provide an axial null depth about 36 db below that at plus or minus 10 degrees anqle off axis. Such a feed with 95 $GH_3$ (3.1 millimeter) radar frequencies can be made compact enough to be fitted into the boatails of projectiles. If transponder circuitry 78 is also provided, a return electromagnetic signal has a sufficient strength to allow the projectile to be tracked more accurately to greater ranges.

The purpose of the On-Board Processor or microprocessor 44 is to receive a message (relayed by the cell and converter 48) from a base station via a laser, and control the detonation of up to eight or more explosive charges (thrusters) based on the data in the message. The projectile is in ballistic flight at the time the message is sent, and the impulses from the explosives cause mid-flight correction of the trajectory. Three parameters are sent to the projectile: time delay after receipt of message, up to 10 seconds, angle (with respect to vertical), and intensity (up to eight charges, synchronized with the rotation). The input to the electronics is the cell 36 which receives the data and provides the vertical reference signal. Power is applied to the circuit only upon firing. The outputs from the circuit are detonation pulses on up to eight lines, one per thruster.

Figure 10:
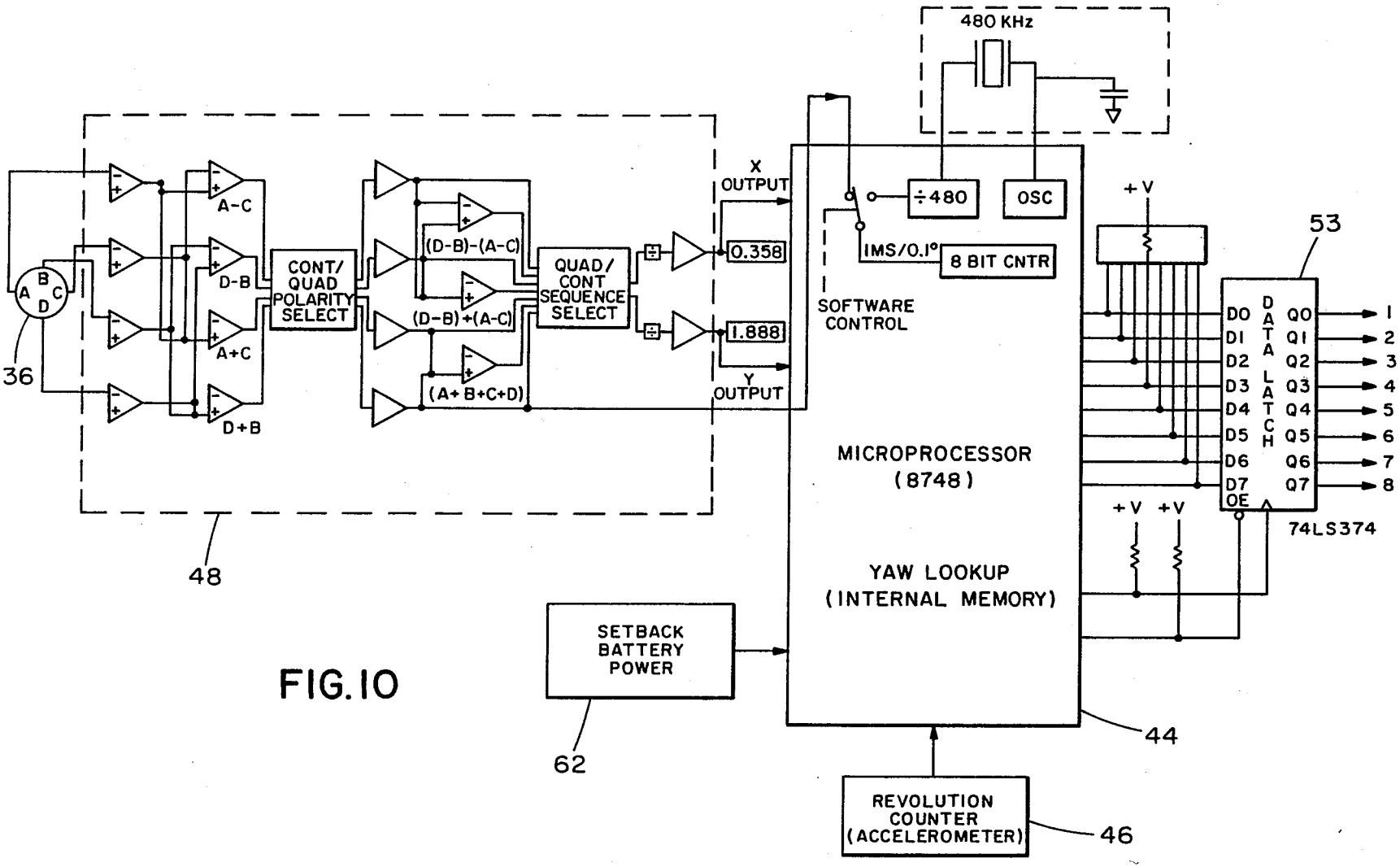
FIG. 10 is an electrical schematic of receiver and processor apparatus of the present invention with certain components shown in block form.
Figure 12:
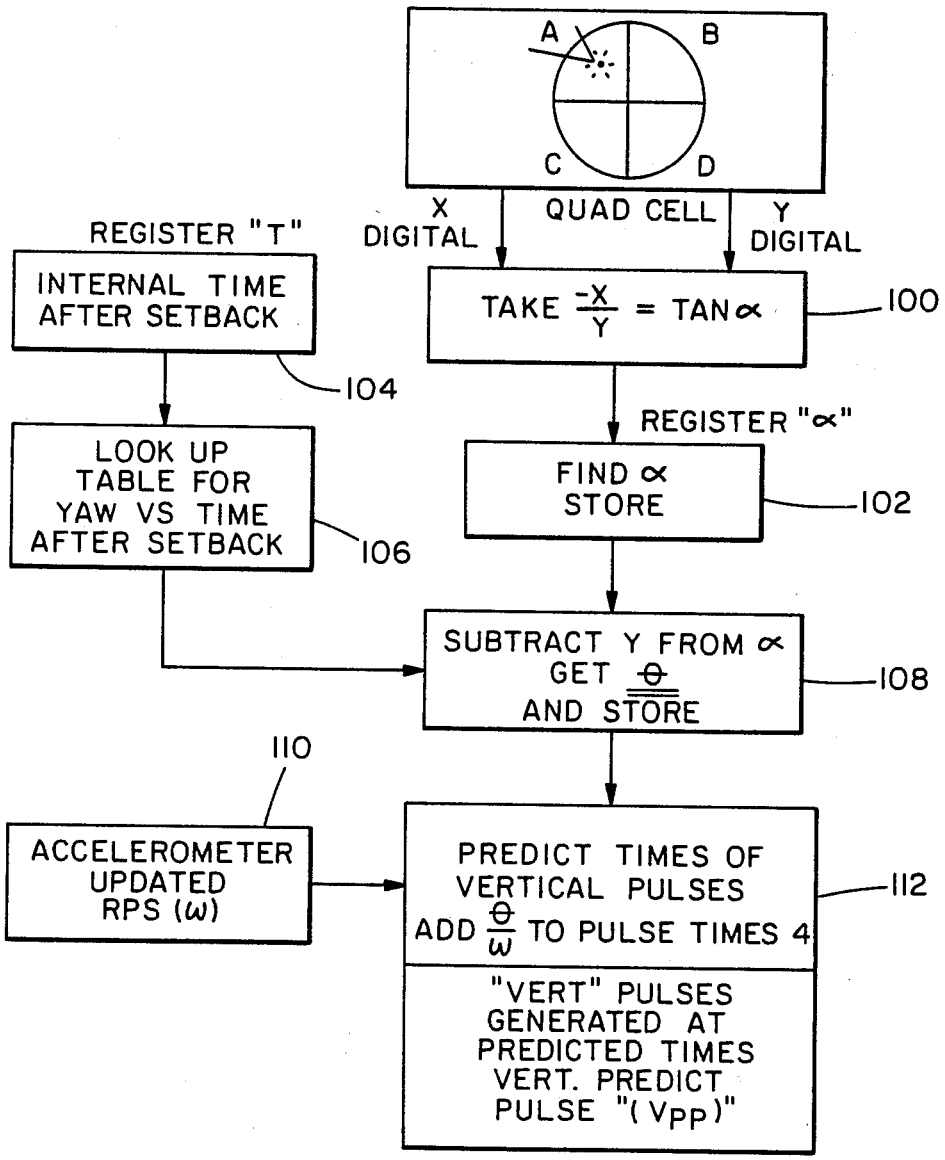
FIG. 12 is a flow diagram relating to the determination of a vertical reference in the projectile and the firing angle of a thruster.
Figure 13:
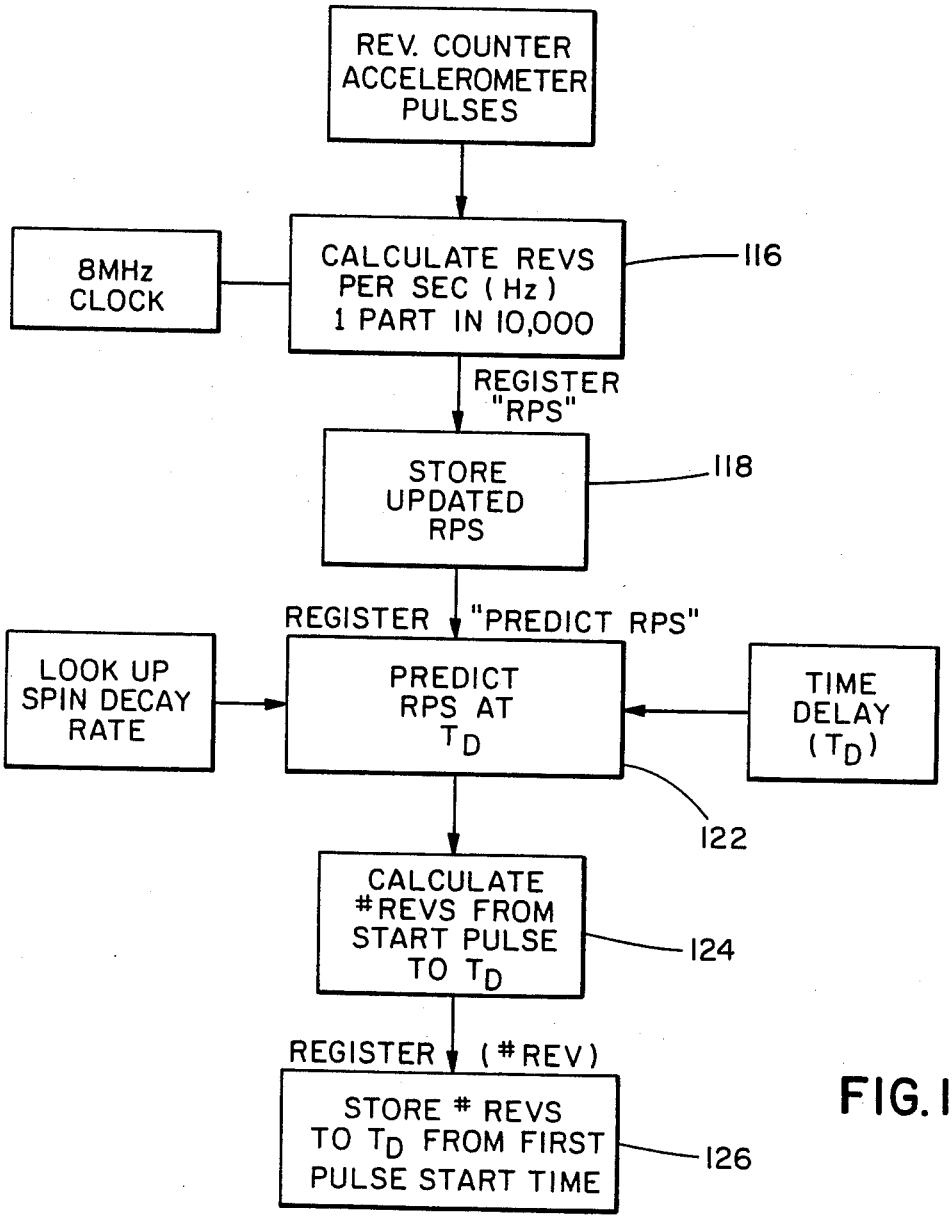
FIG. 13 is a flow diagram relating to counting revolutions of the projectile.
Figure 14:
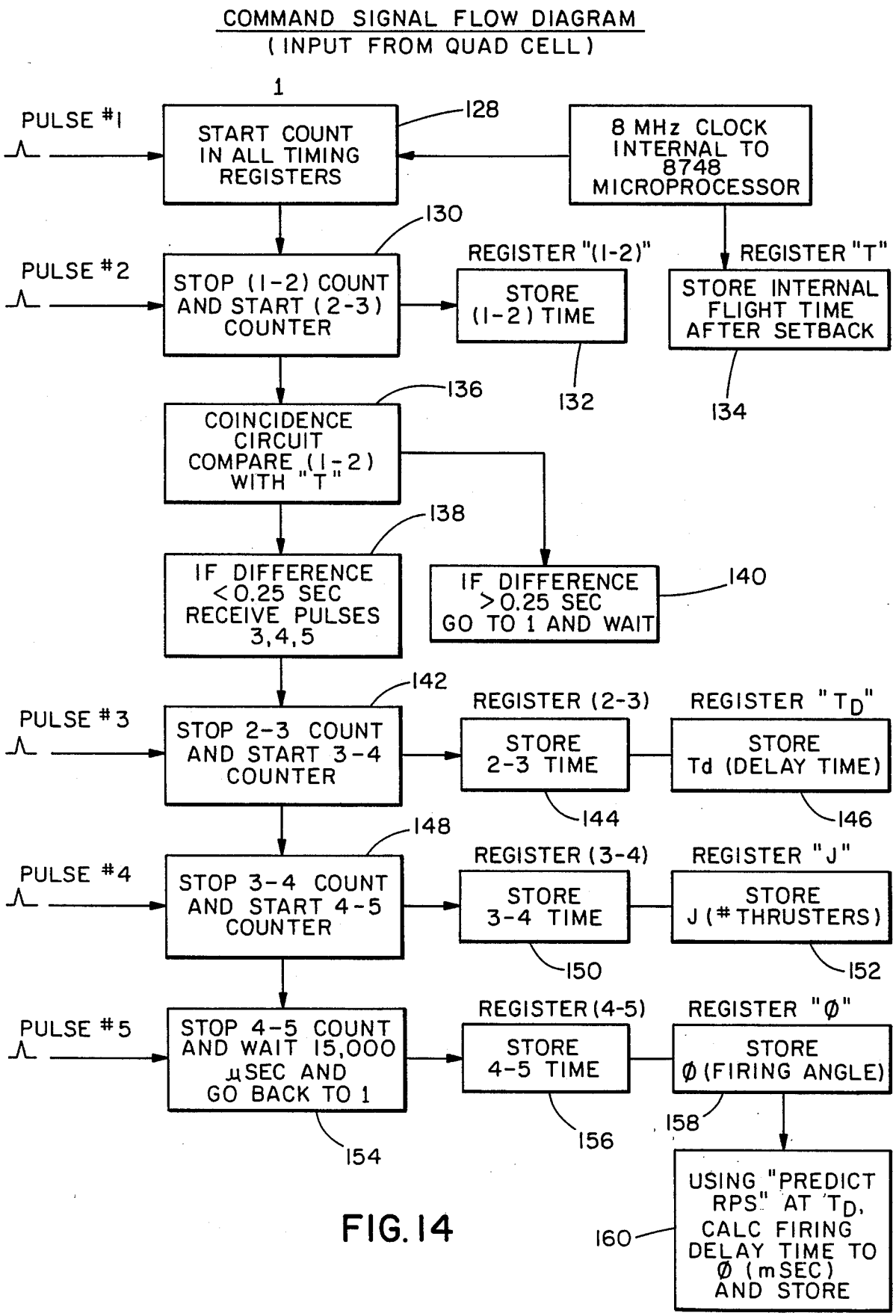
FIG. 14 is a flow diagram illustrating a program for controlling firing of the thruster according to the encoded pulses received by the quad cell detector.

Command decoding is performed using the circuit shown in FIG. 10 in conjunction with the 8748 microprocessor routine shown in the flow chart of FIGS. 12–14.

Figure 11:
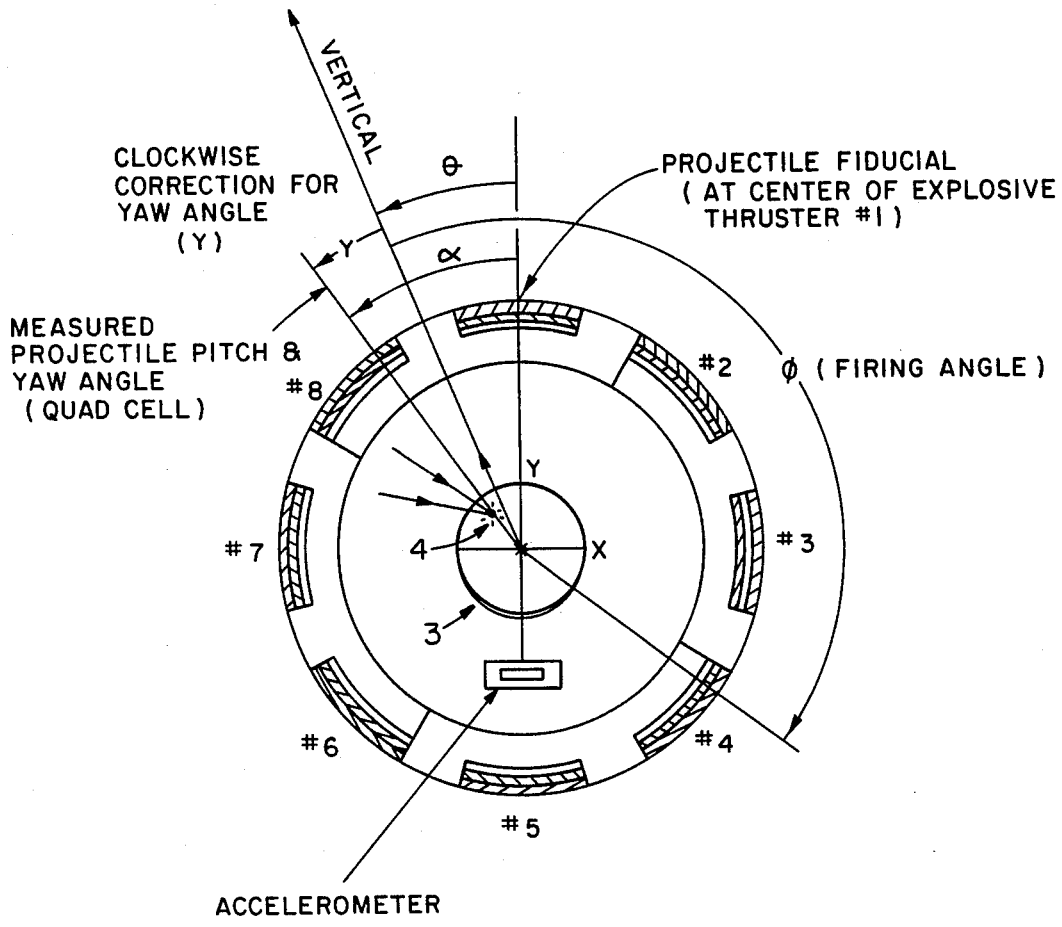
FIG. 11, similar to FIG. 3, shows radiation impinging on the detection surface of the quad cell and illustrates various angular relationships relating to the firing angle of thrusters and the determination of vertical in the projectile.

Referring now to FIG. 11, the fiducial vertical is determined when the accelerometer is in the down or six o'clock position shown. The angle y is the yaw angle which is easily determined as a function of time after firing. The angle $\alpha$ is the angle with respect to vertical measured by the quad cell detector 36. The angle $\theta$ (equal to $\alpha$-Y) gives the angle of the fiducial vertical from true vertical. Finally, the angle $\phi$ is the angle with respect to true vertical about which thruster firing is to be centered.

Referring to the flow diagram of FIG. 12, the digitized input from the cell 36 is used to determine the angle $\alpha$ (steps 100, 102). The yaw angle at a particular time after setback is determined in steps 104 and 106 and, based upon these angles, the angle $\theta$ is calculated and stored, step 108. Based upon the angular velocity-$\Omega$ (calculated using updating counting from the accelerometer 46) in step 110, the times of true vertical pulses can be predicted. Vertical predicted pulses (Vpp) are then generated based on this prediction, commencing after the occurrence of timing pulse 4(D).

Before discussing the flow diagram of FIG. 13, it should be appreciated that the accelerometer 46 is extremely accurate in providing a pulse with each revolution of the projectile. While these pulses may wander a total of about plus or minus ten degrees, the wander or variance from revolution to revolution is very small, about one/one-hundredth of a degree. Referring to FIG. 13, based upon inputs from the 8 MHz clock and the accelerometer 46, revolutions per second are calculated (step 116) and stored (step 118). Based upon the time delay to fire thrusters and the projectile spin decay rate from a lookup table in memory, the predicted spin rate at the time delay can be determined (step 122). The number of revolutions to the end of delay is calculated (step 124) and the number of revolutions to the time delay from the first pulse is stored in step 126.

Referring to the flow diagram of FIG. 14, the occurrence of pulse 1 causes all timinq registers in the 8748 Intel microprocessor to start counting, step 128. The occurrence of pulse 2 causes the timer counting the time interval between pulses 1 and 2 to stop and a timer counting the interval between pulses 2 and 3 to start, step 130. The decoded time between pulses 1 and 2 is compared with the internal generated flight time of the projectile (step 136) to determine if that particular projectile is being addressed, step 138, or if the internal registers should be cleared, step 140. The arrival of the third pulse stops the counting of the time between the second and third pulse (which is the time delay stored in step 146) and starts the counting between pulses three and four, step 142. When the fourth pulse arrives, the counting of time for the 3–4 interval which equates to the number J of thrusters to be fired-stored in step 152) and a new count starts, step 148. The occurrence of the fifth or E pulse stops this count (which represents the firing angle 0 stored in step 158) and clears the counters and registers after a second and a half delay step 154. During this delay, based upon the information stored in steps 146, 152 and 158, the appropriate thrusters are fired at the proper angle when the revolutions to delay is zero.

In view of the above, it will be seen that the several objects of the invention are achieved and other advantageous results attained.

As various changes could be made without departing from the scope of the invention, it is intended that all matter contained in the above description shall be interpreted as illustrative and not in a limiting sense.

What is claimed is:

1. A spin-stabilized projectile the trajectory of which can be improved to increase accuracy, said projectile being controlled by a source of electromagnetic radiation providing pulses carrying encoded information, said spin-stabilized projectile comprising;

a nose end;

a midportion having a periphery disposed about which are a plurality of spaced masses and a high explosive charge associated with each mass for high explosive detonation acceleration of its corresponding mass to provide an impulse to said projectile which is applied substantially normal to the longitudinal axis of said projectile;

a boatail defining a cavity open at the rear end of said boatail; and a pulsed electromagnetic radiation processor and receiver mounted in said cavity and including:

(a) means for determining approximate elapsed time from firing of the projectile;

(b) means for determining the direction of the source of electromagnetic radiation with respect to said projectile which provides an indication of true vertical;

(c) means for determining approximate vertical;

(d) means for counting the times between adjacent electromagnetic pulses in a series of such pulses;

(e) means for determining projectile rotational rate; and (f) microprocessor means responsive to said means for determining the approximate elapsed time, said means for determining direction, said means for determining approximate vertical and said means for counting the times between adjacent electromagnetic pulses, said microprocessor means controlling selective high explosive detonation acceleration of said masses to improve said trajectory, said microprocessor means including means responsive to said means for determining the direction and said means for determining approximate vertical to provide a difference between approximate vertical and true vertical.

2. A spin-stabilized as set forth in claim 1 wherein said source of electromagetic radiation is a laser.

3. A spin-stablilzed as set forth in claim 1 wherein said source of electromagnetic radiation is a radar transmitter.

4. A spin-stabilized projectile the trajectory of which can be improved to increase accuracy, said projectile being controlled by a source of electromagnetic radiation providing pulses carrying encoded information, said spin-stabilized projectile comprising:

a nose end;

a midportion having a periphery disposed about which are a plurality of spaced masses and a high explosive charge associated with each mass for high explosive detonation acceleration of its corresponding mass to provide an impulse to said projectile which is applied substantially normal to the longitudinal axis of said projectile;

a boatail defining a cavity open at the rear end of said boatial; and a pulsed electromagnetic radiation and processor receiver mounted in said cavity and including:

(a) means for determining the approximate elapsed time from firing of the projectile;

(b) means for determining the direction of the source of electromagnetic radiation with respect to said projectile;

(c) means for determining approximate vertical;

(d) means for counting the times between adjacent electromagnetic pulses in a series of such pulses;

(e) means for determining projectile rotational rate; and (f) microprocessor means responsive to said means for determining the approximate elapsed time, said means for determining direction, said means for determining approximate vertical and said means for counting the times between adjacent electromagnetic pulses, said microprocessor means controlling selective high explosive detonation acceleration of said masses to improve said trajectory, wherein said boatail comprises a microdetonator corresponding to each of said masses, said projectile midportion comprising a channel in communication between each microdetonator and the high explosive thruster charge for the corresponding mass, said channel holding a detonation train.

5. Receiver apparatus for mounting in the boatail of a spin-stabilized projectile the trajectory of which can be improved by the selective high explosive detonation acceleration of masses carried by said spin-stabilized projectile, said receiver being responsive to pulsed electromagnetic radiation and comprising:

microprocessor means;

means for determining approximate elapsed time from firing of said projectile and providing an output to said microprocessor means;

means for determining rotational rate of the projectile;

means for determining the direction of the source of electromagnetic energy with respect to said projectile and providing an output which provides an indication of true vertical to said microprocessor means;

means for determining approximate vertical and providing an output to said microprocessor means; and means for determining the time between adjacent pulses in a series of such pulses and providing an output to said microprocessor means whereby said microprocessor means can control high explosive detonation acceleration of said masses to improve the trajectory of said projectile, said microprocessor means including means responsive to said means for determining the direction and said means for determining approximate vertical to provide a difference between approximate vertical and true vertical.

6. Receiver apparatus as set forth in claim 5 wherein said radiation is provided by a pulsed laser and wherein said means for determining direction comprises a quadrant cell responsive to impingement of radiation thereon to provide an output indicating the location of said cell where the radiation impinged, said means for determining direction also comprises an infrared transmitting lens for focusing the radiation and a filter both overlaying said quandrant cell.

7. Receiver apparatus as set forth in claim 5 wherein said means for determining time comprises a microcircuit clock, the operation of which is initiated by setback forces applied during acceleration upon firing of the projectile.

8. Receiver apparatus as set forth in claim 5 wherein said means for determining approximate vertical comprises an accelerometer mounted off the projectile axis.

9. Receiver apparatus as set forth in claim 5 wherein said pulse electromagnetic radiation is provided by a radar transmitter and wherein said means for determining direction comprises a waveguide horn.

10. A method of controlling a plurality of spin-stabilized projectiles each carrying a number of masses to be selectively accelerated to improve the trajectory of the spin-stabilized projectiles and each spin-stabilized projectile carrying the receiver apparatus of claim 5, said method including the following steps:

(a) firing said projectiles in series;

(b) providing a series of pulses receivable by the receiver apparatus in the boatail of each projectile, said series of pulses providing pulse-encoded information as to:

(1) which of the projectiles is being addressed, (2) the time delay of high explosive detonation acceleration of masses, (3) the number of masses to be accelerated, and (4) the projectile rotational angle with respect to vertical at which said number of masses are to be accelerated.

11. A method as set forth in claim 10 wherein a laser is used to provide said series of pulses.

12. A method as set forth in claim 10 wherein a radar transmitter is used to provide said series of pulses.

* * * * *

UNITED STATES PATENT AND TRADEMARK OFFICE

CERTIFICATE OF CORRECTION

PATENT NO. : 4,728,057

DATED : March 1, 1988

INVENTOR(S) : Dunne

It is certified that error appears in the above-identified patent and that said Letters Patent is hereby corrected as shown below:

Abstract, line 10, change "boatail" to --boattail--.

Abstract, line 11, change "boatail" to --boattail--.

Column 1, line 30, change "boatail" to --boattail--.

Column 1, line 47, change "nututional" to --nutational--.

Column 2, line 17, change "contolling" to --controlling--.

Column 2, line 28, change "radiation weight" to --lightweight--.

Column 2, line 38, change "boatail" to --boattail--.

Column 2, line 40, change "boatail" to --boattail--.

Column 2, line 56, change "boatail" to --boattail--.

Column 2, line 61, change "boatail" to --boattail--.

Column 3, line 6, change "." (period) to --;-- (semicolon).

Column 3, line 8, change "boatail" to --boattail--.

Column 3, line 12, change "boatail" to --boattail--.

Column 3, line 46, change "boatail" to --boattail--.

Column 3, line 57, change "boatail" to --boattail--.

Column 3, line 58, change "boatail" to --boattail--.

Column 3, line 61, change "quadrature" to --quadrant--.

UNITED STATES PATENT AND TRADEMARK OFFICE

CERTIFICATE OF CORRECTION

PATENT NO. : 4,728,057

DATED : March 1, 1988

INVENTOR(S) : Dunne

It is certified that error appears in the above-identified patent and that said Letters Patent is hereby corrected as shown below:

Column 4, line 26, change "be" to --by--.

Column 5, line 16, change "boatail" to --boattail--.

Column 6, line 15, change "means" to --mass--.

Column 6, line 19, change "MSEC" to --μsec--.

Column 6, line 37, change "boatail" to --boattail--.

Column 7, line 26, replace "of" with --,-- (a comma).

Column 8, line 19, change "boatail" to --boattail--.

Column 8, line 58, change"radiation weight" to --lightweight--.

Column 8, line 63, change "anqle" to --angle--.

Column 8, line 65, change "boatails" to --boattails--.

Column 9, line 23, change "y" to --γ--.

Column 9, line 27, change "Y" to --γ--.

Column 9, line 36, change "Ω" to --ω--.

Column 9, line 59, change "timinq" to --timing--.

Column 10, line 5, before "which" insert --(-- (open parenthesis).

Column 10, line 9, change "0" to --ϕ--.

Column 10, line 27, change ";" (semicolon) to --:-- (colon).

UNITED STATES PATENT AND TRADEMARK OFFICE

CERTIFICATE OF CORRECTION

PATENT NO. : 4,728,057

DATED : March 1, 1988

INVENTOR(S) : Dunne

It is certified that error appears in the above-identified patent and that said Letters Patent is hereby corrected as shown below:

Column 10, line 36, change "boatail" to --boattail--.

Column 10, line 37, change "boatail" to --boattail--.

Column 10, line 40, after "determining" insert --the--.

Column 10, line 64, after "spin-stabilized" insert --projectile--.

Column 10, line 66, after "spin-stabilized" insert --projectile--.

Column 11, line 15, change "boatail" to --boattail--.

Column 11, line 16, change "boatial" to --boattail--.

Column 11, line 38, change "boatail" to --boattail--.

Column 11, line 44, change "boatail" to --boattail--.

Column 12, line 24, change "quandrant" to --quadrant--.

Column 12, line 45, change "boatail" to --boattail--.

Signed and Sealed this

Seventeenth Day of January, 1989

*Attest:*

*Attesting Officer*

DONALD J. QUIGG

*Commissioner of Patents and Trademarks*